United States Patent [19]

Holt

[11] 4,135,711

[45] Jan. 23, 1979

[54] TETHERED AIRPLANE ASSEMBLY

[76] Inventor: Ralph J. Holt, 5069 LaSierra Blvd., Riverside, Calif. 92503

[21] Appl. No.: 814,181

[22] Filed: Jul. 11, 1977

[51] Int. Cl.[2] ..... A63H 27/04

[52] U.S. Cl. ..... 272/31 A; 46/77; 339/5 M

[58] Field of Search ..... 272/31 A, 31 B, 31 R, 272/34; 273/97 R, 97 A, 95 B, 86 B, 105.4; 46/77, 78, 210, 249, 255; 191/12 R; 339/5 R, 5 A, 5 M, 5 P, 182 RS

[56] References Cited

U.S. PATENT DOCUMENTS

| | | | |
|---|---|---|---|
| 1,201,839 | 10/1916 | McCoole | 272/34 |
| 1,769,414 | 7/1930 | Brandon et al. | 272/31 A |
| 2,292,705 | 8/1942 | Lohse | 272/31 A |
| 2,471,808 | 5/1949 | Baker | 339/5 M X |
| 2,680,619 | 6/1954 | Reiter | 272/31 A X |
| 3,686,514 | 8/1972 | Dube et al. | 339/5 M X |
| 3,731,424 | 5/1973 | Meyer | 46/249 X |
| 3,762,702 | 10/1973 | Keele et al. | 272/31 A |

FOREIGN PATENT DOCUMENTS

| | | | |
|---|---|---|---|
| 691297 | 4/1940 | Fed. Rep. of Germany | 273/95 B |
| 2550673 | 5/1976 | Fed. Rep. of Germany | 272/31 A |
| 588946 | 6/1947 | United Kingdom | 272/31 A |

*Primary Examiner*—Richard C. Pinkham
*Assistant Examiner*—Arnold W. Kramer
*Attorney, Agent, or Firm*—Herbert E. Kidder

[57] ABSTRACT

An electrically powered tethered model airplane connected to a central post or pylon. The tether line is also the electrical wire to supply power to an electric motor in the airplane that drives the propeller. The airplane assembly typically has two airplanes connected to the central pylon. A unique connection arrangement at the interface of the tether lines and the central pylon allows not only for electrical contact, but also for circular movement of the tether lines and planes around the pylon without becoming wrapped or wound on the pylon. Two transformers are connected to the electrical connection at the top of the pylon, enabling two operators to control their respective airplanes for various maneuvers.

2 Claims, 4 Drawing Figures

TETHERED AIRPLANE ASSEMBLY

BACKGROUND OF THE INVENTION

The present invention is directed to tethered model airplanes and, more particularly, is directed to electrically powered airplanes operating around a stationary central pylon.

Typically, most tethered model airplanes are gasoline powered, requiring continual maintenance and care to operate. The gasoline engine must be cleaned periodically to insure that it provides good performance. Since these gasoline engines are small and carry little fuel at a time, the length of flight is limited.

The requirement to refuel the airplane is not only burdensome and time consuming, but also presents a source of potential danger, Consequently, the use of such planes is left to either older teenage children or adults. Such special handling of the airplane, with the requirement for gasoline and constant maintenance, eliminates the safe and practical use by smaller children and discourages use by any who are not the most avid hobbyists.

In addition, most tethered model airplanes require specialized skills to control the flight. Such dexterity is not in the grasp of the small child or occasional user. Since there are typically two separate lines for controlling the flight, the tether lines can become tangled by even the most skilled user. The control of these planes requires that the operator stand at the center of the circular flight path and rotate with the flight of the plane. This constant turning is uncomfortable for many users of such planes.

In many instances two users of such tethered gasoline planes desire to engage in aerial competition. However, each user is limited by the amount of gasoline his plane can carry, and further, the potential of the different tether lines becoming entangled increases.

Other types of prior art model airplanes include remote control units, eliminating the requirement for tether lines and, in some models, eliminating gasoline engines. However, these systems are usually quite expensive. and are used only by the most avid hobbyist.

Consequently, many individuals, both adults and children, do not have the opportunity to enjoy the operation of a tethered model airplane, because these planes are either too expensive, unsafe, require too much maintenance, or require too much skill to enjoy. There is a definite lack in the type of model airplanes available to satisfy the occasional family user.

SUMMARY OF THE INVENTION

The present invention comprises a tethered airplane assembly having a pair of tethered airplanes connected to a central post or pylon around which the planes operate. Each plane is powered by a small electrical motor driving its propeller, and flight is controlled by a remote control mechanism which increases or decreases the voltage to respectively cause the plane to climb or descend. The tether lines are also the electrical wires that supply power to the planes.

Wires from the remote control boxes for each plane extend to the pylon and up the center of the pylon to the top. A unique electrical interface connection is present between the tether lines and the top of the pylon, not only to provide electrical contact, but also to allow rotative movement of the planes around the pylon.

This invention presents an enjoyable and easy-to-operate model airplane with none of the disadvantages of the prior art arrangements. Two individuals can have hours of enjoyment operating the two electrically powered planes by simply adjusting a control knob to vary the voltage and current as desired. There is no fuel limitation and no burdensome maintenance requirements.

Since the operators can sit remote from the central pylon, there is no need for the individual to make continual turns to follow the flight path. The operators can sit in a comfortable position and concentrate on the easy control of the airplane by simply varying the amount of current and voltage to the airplane. Two people can have continued aerial competition such as dogfights, etc., for as long as they desire. The planes can be remotely controlled for both takeoffs and landings.

There are no moving control parts on the planes, as all control is done by the amount of current and voltage supplied to the planes. Increased voltage with a corresponding increased speed of the airplane causes an aerodynamic lift to the plane's wing configuration. Conversely, decreased voltage causes a slowing with increased air drag to result in a descent of the plane.

DETAILED DESCRIPTION OF THE INVENTION

Figure 1:
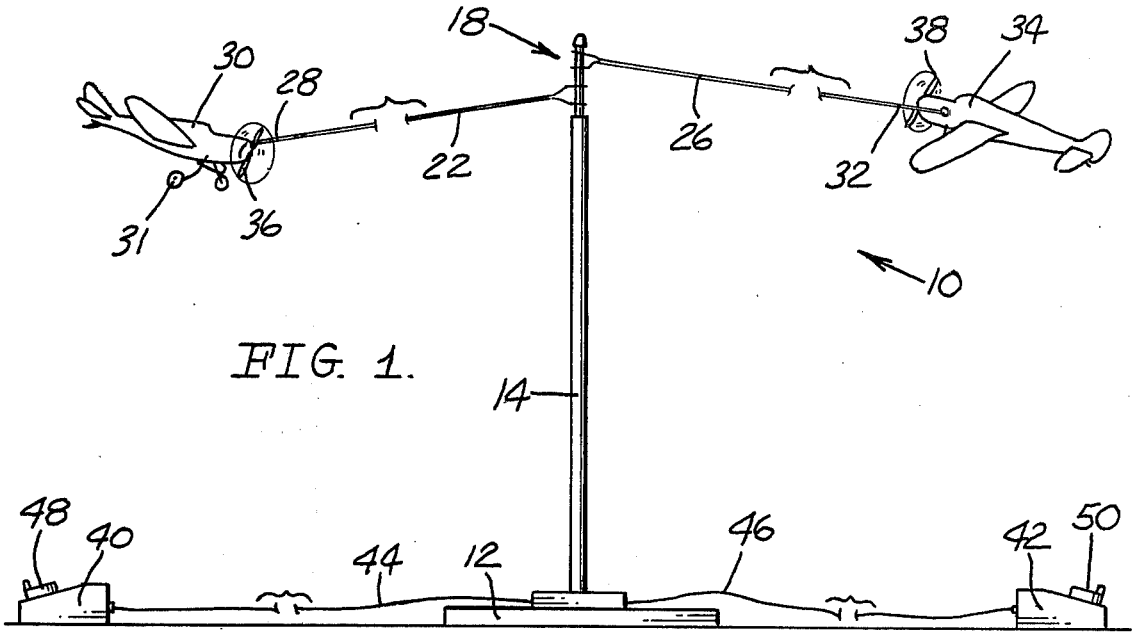
FIG. 1 is a perspective view of the present invention.

The tethered airplane assembly 10 of the present invention is shown in FIG. 1, comprising a support base 12 on which is mounted a central post, or pylon 14. Connected to the top end of the pylon 14 is a unique interface mounting 18 which receives one end of a first tether line 22 and one end of a second tether line 26. The other end 28 of the first tether line 22 is connected to one model airplane 30, while the other end 32 of the second tether line 26 is connected to a second model airplane 34.

The airplanes 30 and 34 are powered by small electric motors (not shown) which drive the respective propellers 36 and 38. The tether lines 22 and 26 are two-conductor electrical wires which connect the electric motors of the respective planes 30 and 34 to respective control boxes 40 and 42. A typical electrical single pin snap-in connector jack and socket can be used to connect the lines 22 and 26 to the respective planes 30 and 34. This will allow easier disconnect of either plane if the plane needs repair. Leading from one control box 40 is a two-conductor wire 44 which passes through the base 12 and up the hollow interior of pylon 14 to the interface mounting 18 to connect with the tether line 22. Similarly, another two-conductor wire 46 extends from the other control box 42, through the base 12, and up the pylon 14 to the interface mounting 18 to connect with the tether line 26.

The control boxes 40 and 42 may conveniently consist of transformers of the type used in model train outfits, so that the voltage and current can be varied to the electric motors of the respective planes 30 and 34. The control knobs 48 and 50 on the respective control boxes 40 and 42 provide ease in control of the planes.

Planes 30 and 34 have the typical control components such as ailerons, elevators and rudders, all of which are fixed in position, so that flight maneuvers result from the speed of the plane controlled by the power supplied. As the voltage and current are increased by use of the control knob 48 on control box 40, the plane 30 will increase speed. Because of aerodynamic principles in conjunction with the wing design, increased speed will cause a lift in the plane 30. When the control knob 48 decreases the voltage and current, the plane 30 will slow, causing increased significance of drag forces, resulting in descent of the plane 30. Power is supplied to the control boxes 40 and 42 from a source not shown, such as a household electrical outlet.

Figure 4:
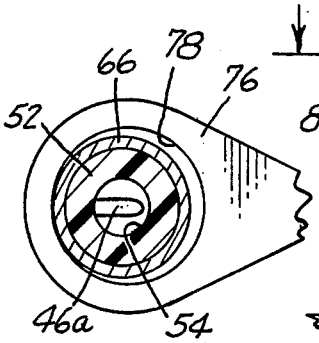
FIG. 4 is a transverse sectional view taken at 4—4 in FIG. 3.
Figure 3:
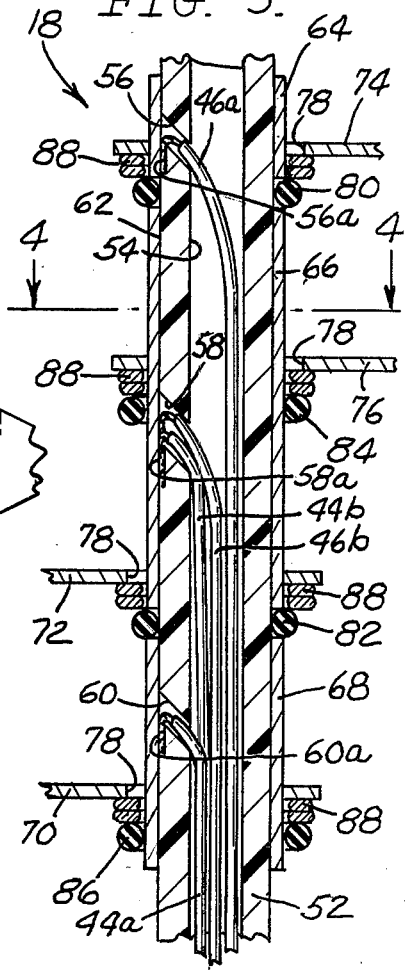
FIG. 3 is a sectional view taken along line 3—3 in FIG. 2.

The movement of the planes 30 and 34 around the pylon 12 is made possible by the interface mounting 18 which is shown in more detail in FIGS. 3 and 4. The mounting 18 has a dielectric tube 52 which is inserted into the top end 16 of the pylon 14 in FIG. 1. The tube 52, in FIG. 3, has a hollow interior 54 designed to receive in FIG. 1 the wires 44 and 46 which extend from the control boxes 40 and 42. It will be noted in FIG. 3 that the wires 44 and 46 each contain two separate conductors or leads 44*a* and 44*b*, and 46*a* and 46*b*, respectively. The leads 44*a* and 46*a* are the positive electrical leads, while 44*b* and 46*b* are the negative ground leads.

The tube 18 has a top aperture 56, a middle aperture 58 and a bottom aperture 60, extending from the exterior 62 of the tube to the interior 54. The apertures 56, 58 and 60 are at a downward slant to facilitate placement of the wires 44*a*, 44*b*, 46*a* and 46*b*, as will be explained later. Further, adjacent each slot on the exterior 62 of the tube 52 are shallow recesses 56*a*, 58*a*, 60*a*, to receive the bared ends of the wires 44 and 46. The middle aperture 58 is larger than the other apertures 56 and 60, because aperture 58 receives the ends of the two ground wires 44*b* and 46*b*.

Press-fitted onto the exterior 62 of tube 52 are a top conductive sleeve 64, a middle conductive sleeve 66, and a bottom conductive sleeve 68. The bare ends of the wires 44*a*, 44*b*, 46*a* and 46*b* extend slightly beyond the exterior 62 of the tube when these wires are protruding from their respective apertures. When the sleeves 64, 66 and 68 are press-fitted onto the tube 18, the bared ends of the wires are bent downwardly into the respective recesses 56*a*, 58*a* and 60*a*, and establish a tight electrical contact between wire 46*a* and sleeve 64, as well as electrical contact between wires 44*b* and 46*b* and sleeve 66. Tight electrical contact is also established between wire 44*a* and sleeve 68.

Figure 2:
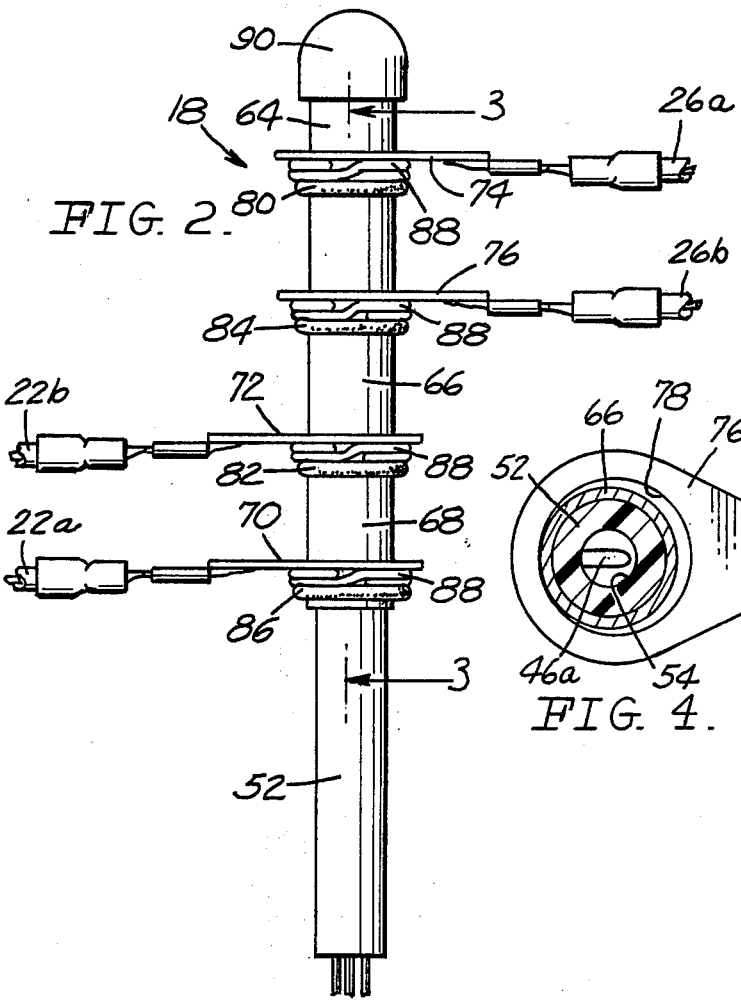
FIG. 2 is an enlarged fragmentary side elevational view of the tether line/pylon interface.

As shown in FIG. 2, each of the tether lines 22 and 26 in FIG. 1 is comprised of two leads or conductors 22*a* and 22*b* and 26*a* and 26*b*, respectively. Connected to each of these strands 22*a*, 22*b*, 26*a* and 26*b*, is an eye member 70, 72, 74, 76, respectively. Each eye member has an aperture 78, shown in FIG. 4 for eye member 76. Each aperture 78 is slightly larger in diameter than the diameter of the sleeve 64, 66 and 68 so as to allow free rotation of the eye members around the sleeves on which they are positioned as shown in FIG. 2.

Eye members 72 and 76 are positioned on the middle sleeve 66, while eye member 74 is on the top sleeve 64 and eye member 70 is on the bottom sleeve 68. Since wires 44*b* and 46*b* in FIG. 3 are ground wires and both contact conductive middle sleeve 66, middle sleeve 66 is a common ground sleeve. Both wires 22*b* and 26*b* are ground wires for the respective planes 30 and 34 and, therefore, they can both contact the common ground middle sleeve 66, eliminating the need of a separate conductive sleeve for each of the wires 22*b* and 26*b* and the respective eye members 72 and 76.

Positive wire 22*a* for plane 30 contacts through eye member 70 and bottom sleeve 68 which is electrically connected by positive wire 44*a* to control box 40 for plane 30. Similarly, positive wire 26*a* from plane 34 contacts through eye member 74 and top sleeve 64 which is electrically connected by positive wire 46*a* to control box 42 for plane 34. The top sleeve 64 in FIG. 3 is insulated from the middle sleeve 66 by a rubber O-ring 80. The middle sleeve 66 is insulated from the bottom sleeve 68 by a rubber O-ring 82. O-ring 80 also provides support for the eye member 74 to retain it on top sleeve 64. O-ring 82 provides support for eye member 72 to retain it on the middle sleeve 66. Another O-ring 84 frictionally grips the middle sleeve 66 to position and retain the eye member 76 on the middle sleeve away from eye member 72 also on the middle sleeve. A final O-ring 86 is on the bottom sleeve 68 to retain the eye member 70 on the bottom sleeve.

Because of the high friction of the rubber or other suitable elastic material from which the O-ring is made, a low friction metal ring or washer 88 is placed below each of the eye members on its adjacent O-ring to allow the eye members to rotate around the sleeves with a minimum of friction.

A cap 90 in FIG. 2 is placed on top of the tube 18 to keep the eye member 74 from pulling off the top sleeve 64.

Turning to the general operation of the present invention, reference is made to FIG. 1. The length of tether lines 22 and 26 can be approximately ten to thirty feet. The pylon 14 can be made to be telescoping, so that it could have a height range of four to eight feet. The base 12 is made of sufficient weight to remain stationary and support the pylon while the planes 30 and 34 are in flight. The wires 44 and 46 can be of any convenient length to allow the operator to position the control boxes 40 and 42 at a comfortable distance from pylon 14.

For simplicity, the operation of only one plane 30 will be discussed. The operator of plane 30 will use control box 40 with the control knob 48 to maneuver the flight of the plane. Initially, the plane, having wheels 31, will be on the ground with no power going to the electric motor. When the control knob 48 is moved to supply current and voltage to the motor in plane 30, the propeller 36 will turn and, if enough power is supplied, the plane will move forwardly and become airborne. As the power is increased, the speed of the plane is increased, causing the plane to climb to the desired altitude where the power is held constant for level flight. During flight the plane may be maneuvered from one altitude to another by slightly varying the power supplied. When the flight is completed, the power can be gradually reduced to allow the plane to settle down and land.

Continued electrical contact is maintained from the control box 40 to the plane 30 through interface mounting 18. The eye members 70 and 72 freely rotate around the bottom sleeve 68 and middle sleeve 66 respectively.

After a few uses of the present invention, the beginning operator will obtain enough proficiency to have hours of enjoyment either alone or in competition with another operator controlling the othe plane 34.

While I have shown and described in considerable detail what I believe to be the preferred form of my invention, it will be apparent to those skilled in the art that the invention is not limited to such details, but may take various other forms within the scope of the claims.

I claim:

1. A tethered airplane assembly comprising:

a support base;

a central pylon mounted on said support base;

a first tether line connected to a first airplane;

a second tether line connected to a second airplane;

said first and second airplanes each having an electric motor driving the propeller;

said first and second tether lines each having a positive wire and a negative ground wire, and each tether line having one end thereof connected to the top portion of said central pylon;

a first remote control box electrically connected to said first airplane through said pylon and said first tether line;

a second remote control box electrically connected to said second airplane through said pylon and said second tether line;

means located at the top portion of said central pylon for electrically connecting said one end of said first and second tether lines in rotative contact with the pylon so as to allow said tether lines to swing around the pylon;

said means comprising a dielectric hollow tube mounted on the top portion of said pylon;

at least three conductive sleeves placed one above the other on said tube;

conductive metal eye members connected to said one end of each of said positive wires and said negative ground wires of said tether lines, each of said eye members having an aperture slightly larger in diameter than said sleeve, said apertures of said eye members being positioned on said sleeves to rotate freely around the sleeves while maintaining electrical contact with the sleeves;

said dielectric hollow tube having at least three apertures between the exterior of the tube and the interior of the tube, said apertures being positioned so that each of said sleeves is covering one of said apertures; and electrical wires extending from each of said remote control boxes through said the interior of said pylon and said tube, each of said control box electrical wires having a separate positive wire and a ground wire, one end of said positive wire of one control box being inserted through one of said apertures in said tube and electrically connected to one of said sleeves, one end of said positive wire of the other of said control box wires being inserted through a second of said apertures in said tube and electrically connected to the second of said sleeves, said ground wires of each of said control boxes being inserted through the third of said apertures in said tube and each electrically connected to the third of said sleeves, said third sleeve being positioned between said first and second sleeves, and serving as a common ground for both of said airplanes.

2. A tethered airplane assembly as defined in claim 1, wherein the eye members of said one of said tether lines are positioned with the positive wire eye member on said first sleeve and the ground wire eye member on said third sleeve, the eye members of said second of said tether lines are positioned with the positive wire eye member on said second sleeve and the ground wire eye member on said third sleeve.

* * * * *